United States Patent [19]

Alter

[11] 4,319,748

[45] Mar. 16, 1982

[54] SPORTS TRAINING DEVICE

[76] Inventor: Efim Alter, 7533 Horrocks St. 1st Flr., Philadelphia, Pa. 19152

[21] Appl. No.: 156,566

[22] Filed: Jun. 5, 1980

[51] Int. Cl.[3] ..... A63B 69/00

[52] U.S. Cl. ..... 272/93; 273/1.5 A; 273/29 A; 273/55 R; 273/1 GE

[58] Field of Search ..... 273/1.5 R, 1.5 A, 55 R, 273/1 GE, 411, 29 R, 29 A; 272/78, 116, 93

[56] References Cited

U.S. PATENT DOCUMENTS

| | | | |
|---|---|---|---|
| 992,868 | 5/1911 | Gorman | 272/78 |
| 2,234,364 | 11/1941 | Carberry | 273/55 R |
| 2,305,187 | 12/1942 | Neiden | 272/78 X |
| 3,096,979 | 7/1963 | Lacy | 273/55 R X |
| 3,606,324 | 9/1971 | Welbourn et al. | 273/1 GE |
| 3,658,332 | 4/1972 | Adduci et al. | 273/55 R |

*Primary Examiner*—Paul E. Shapiro

*Attorney, Agent, or Firm*—Benasutti Associates, Ltd.

[57] ABSTRACT

A sports training device adapted to improve the peripheral vision, footwork and upper body and head agility of a user is disclosed. The preferred embodiment of the device comprises a pair of angularly adjustable oscillating pendular members adapted to swing past the user's head so that he must bob and weave to avoid being struck by them. The device further comprises adjustment means to vary the vertical height and pendular and angular relationships so that the device may be easily adapted to the particular needs of a user. Pivot means adapted to set up varying pendular oscillatory motions, ranging from fairly simple to quite complex, depending on how a movement thrust is imparted to said pendular members are also provided.

11 Claims, 8 Drawing Figures

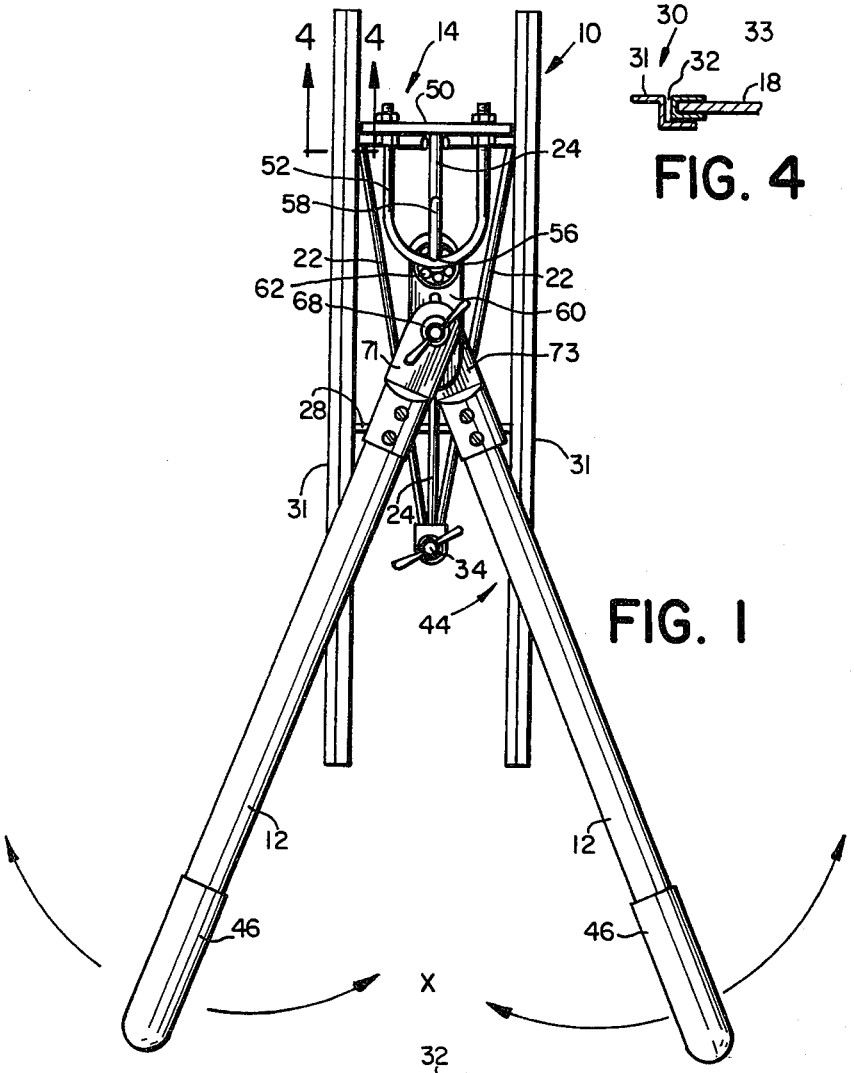
FIG. 1
FIG. 4
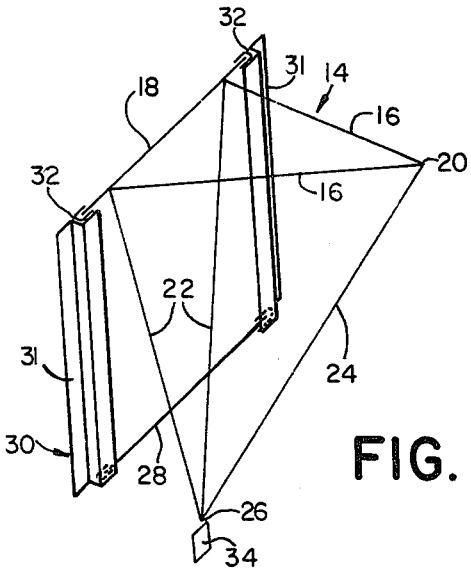
FIG. 3

SPORTS TRAINING DEVICE

BACKGROUND OF THE INVENTION

The present invention relates to a sports training device, and more particularly to one which may be used to train athletes and other people who are interested in improving their peripheral perception, footwork, and upper body and head agility.

One problem encountered in training athletes for such sports as basket ball, tennis, boxing and football is the necessity to improve their capabilities in physical perception, footwork and upper body and head agility. While there are many physical training devices available for improving an athlete's bodily strength and endurance, there are few, if any, which are adapted towards the improvement of the capabilities in these other areas, even though such an improvement may be just as important for outstanding performance in these sports. It has been recognized that if an athlete's capabilities can be improved in these other areas, superior performance may be achieved in competition and the subject invention is adapted towards such an improvement.

SUMMARY OF THE INVENTION

The present invention comprises a pendulum assembly having one or more distinctly spaced apart padded members associated therewith. As the pendulum assembly oscillates these members pass successfully by a given training point which may, for example, be disposed directly under the pendulum fulcrum. An individual whose head or upper body is disposed at such a training point must first see, duck or in someway move from side to side in order to avoid being struck by the swinging padded end portions of the members, then must reorient himself with respect to these members to prepare for the return swing thereof. While many training techniques may be utilized in combination with this unit, it is preferred, for example, to use this apparatus to bob and weave with respect to the moving end portions so that a figure 8 is described with respect to them by the head or upper body of the athlete using the device. In order to vary the cycle time and difficulty of the exercises, it anticipated that the members, which are adjustable with respect to each other, can be set so that their end portions are disposed at variable angular spacings. By adjusting the spacings and therefore the pendular arc, the difficulty of the exercise may be substantially increased. Thus, the apparatus provides an ample opportunity for improving such factors as peripheral vision, footwork and agility.

Thus, the principal object of the subject invention is the development of an adjustable apparatus for using pendulum means to improve the peripherial vision, footwork, body and head agility of an athlete in training.

It is a further object that such apparatus be readily adjustable so that athletes of different size and physical capabilities can use it.

These and other objects of my invention will become apparent from the following description with reference to the accompanying drawings.

BRIEF DESCRIPTION OF THE DRAWINGS

FIG. 1 is a front view of a sports training device as described herein.

FIG. 3 is a diagram illustrating the geometric interrelationship of the various structural components comprising a frame for a sports training device as shown in FIG. 1.

FIG. 4 is an cross sectional view of the support assembly along the lines 4—4 in FIG. 1.

DETAILED DESCRIPTION OF THE INVENTION

Figure 2:
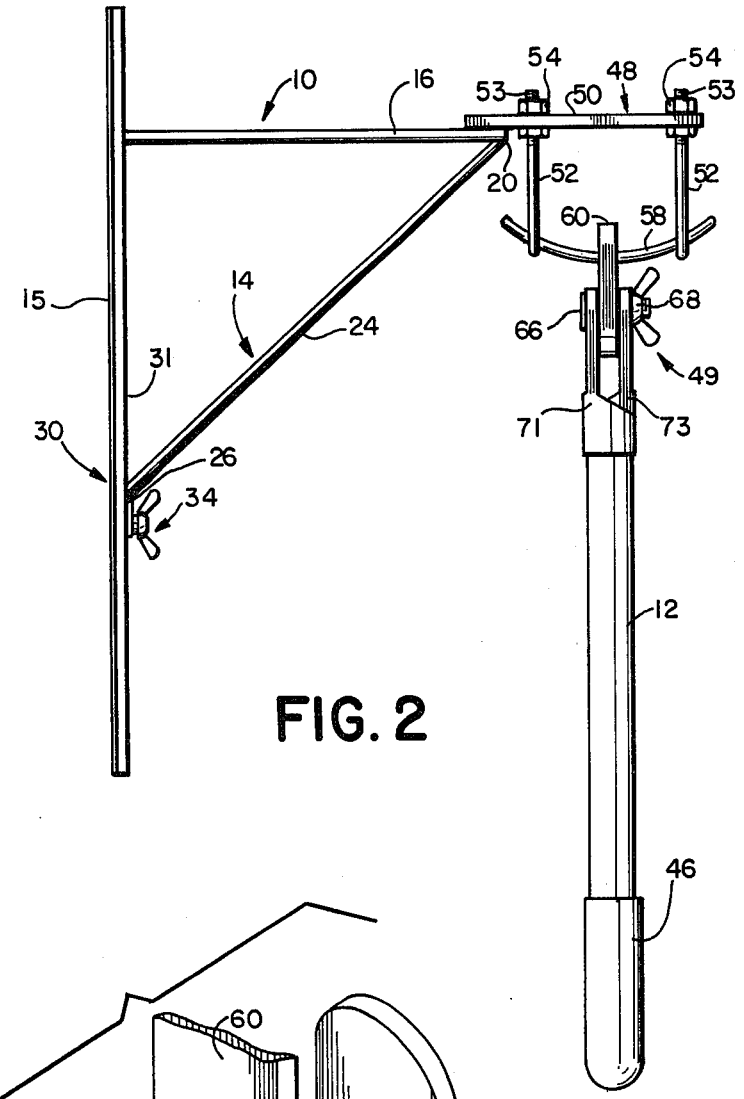
FIG. 2 is a side view of the sports training device as shown in FIG. 1.

Referring now to FIGS. 1 to 3, we see several views of the preferred embodiment of a sports training device 10 as described hereinabove. As shown, the device comprises at least one and, preferrably, two perpendicularly suspended pendular members 12 which are mounted onto the outermost extremity frame means 14 and adapted to follow an oscillatory path when set in motion. As shown schematically in FIG. 3, frame means itself 14 is basically in the form of an inverted, skewed, three-sided pyramid which is adapted to be attached to a wall 15. The angular relationships shown are illustrated by way of example and are not considered to be critical. Similarly the materials of construction are not critical, the only limitation being that they be strong enough to support the structure and light enough to allow easy adjustment. There are numerous low cost steel and aluminum alloys which meet these requirements and any of them can be used.

The inverted triangular base of the frame pyramid is formed by the cooperation of a pair of outwardly disposed, upper struts 16 with a horizontal upper mounting brace strut 18 set along wall 15 and to which their inner ends are attached. Struts 16 join together at junction point 20 to form the apex of the base triangle. Defining the sides of the pyramid are a pair of angled side struts 22 which are also disposed along but not attached to wall 15 and diagonal front strut 24 which is inwardly directed from base apex 20, all of which join together at the inverted peak 26 of the pyramid.

Parallel to brace strut 18 attached to the side struts 22 at an intermediate point approximately two thirds of the distance between the pyramid base and peak 26 is a lower horizontal mounting brace 28. As shown most clearly in FIG. 3, mounting braces 18 and 28 both fit into vertical wall mount means 30 which are bolted or otherwise attached to wall 15 and which is in the form of a complimentary pair of inwardly opening parallel, vertical, Z-shaped channels 31, said openings forming a pair of vertical gaps 32 into which the ends of these braces fit. As shown in FIG. 4, the ends of the braces are covered with a polyethylene or other slideable bearing surface material 33 which allows frame means 14 to be moved freely up and down within the vertical gaps 32 in channel structure 31.

Figure 5:
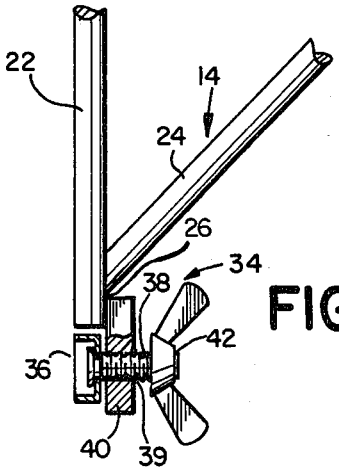
FIG. 5 is a enlarged detail of the locking means of the apparatus shown in FIG. 1.

Locking of frame means 14 within mounting means 30 is handled with adjustment means 34 which is shown in more detail in FIG. 5. As shown, this is provided at inverted peak point 26 where the two side struts 22 and front strut 28 join together to form the pyramid structure of frame 14. Adjustment means 34 comprises a pressure pad 36 threadably mounted with stud 38 through a more or less centrally positioned hole 39 in mounting plate 40 and having a handle 42 on outermost end of stud 38. Mounting plate 40 is physically attached to frame means 14 so that when pressure pad 36 is caused to press against wall 15 by the clockwise rotation of handle 42, it is forced to move relatively away from said wall causing mounting plate 40 and therefore frame 14 to rotate slightly outwardly. This rotation acts to cause lower support brace 28 to move outwardly and upper support brace 18 to move inwardly so that they will bear against the front and rear surfaces of the gaps 32 in channels 31. The bearing pressure developed by this rotation of the braces provides enough frictional resistance to slidingly lock frame 14 firmly in place within mount means 30 at any vertical position where it is set. Counterclockwise rotation of handle 42 reverses the process so that said bearing pressure is relieved. When this is done, frame 14 can then be slid up and down within mount means 30 to be repositioned at another location.

The active portion of the subject invention is attached to frame means 14 at base apex point 20, the outermost point of frame 14. As described hereinabove and as shown in FIGS. 1 and 2, swinging pendulum means 44, having in the preferred embodiment two angularly adjustable pendular members 12 hangs unobstructedly and pivotally therefrom. Each of members 12 is, in the preferred embodiment, made from a circular tube. This is primarily for the purpose of preventing possible injury to the user by eliminating any sharp edges which might come in contact with the user's body, particularly the head. The potential for injury is further reduced by placing over the lower, outer end of each member 12 a resilient pad 46. For purposes of illustration, the assembly is vertically adjusted so that the user's eyes will be at the point marked with an "X" in FIG. 1. When this is done, his head will be within the line of travel of the end pads 46 and the exercise will depend as much on visual acuity as on physical dexterity.

Figure 6:
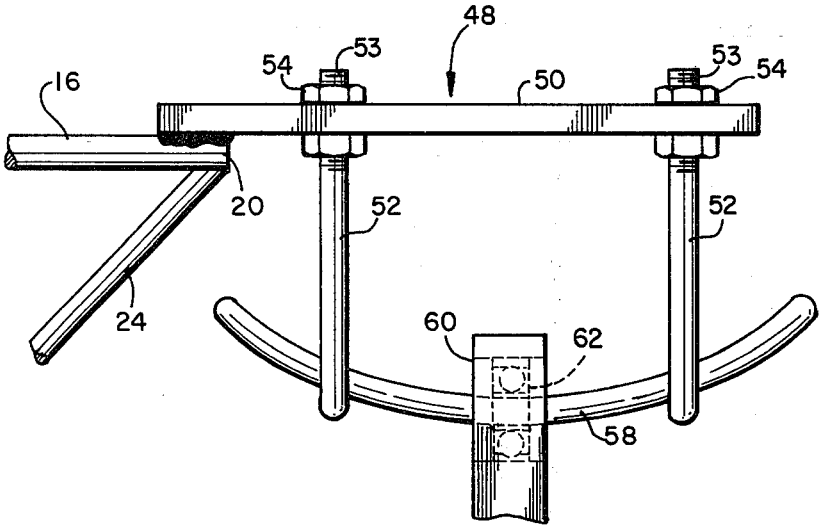
FIG. 6 is an enlarged side view of the upper pivot means of the subject invention.
Figure 7:
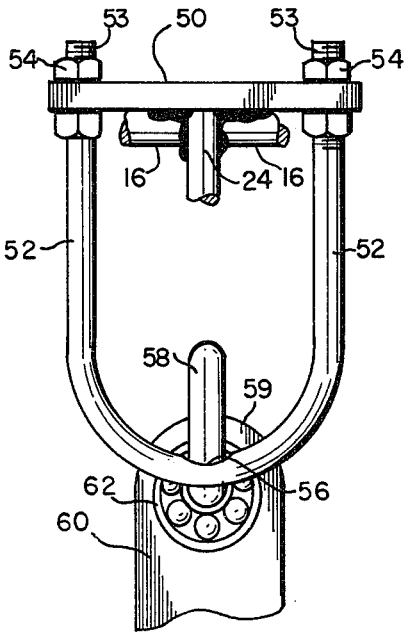
FIG. 7 is an end view of the pivot means shown in FIG. 6.

The particular pendular swinging motion which is established is set up by the cooperation of an upper pivot means 48, which is attached to base apex 20 of frame means 14 with a lower pivot means 49 to which both pendular members 12 are attached. Referring now to FIGS. 6 and 7, we see a side and end view of upper pivot means 48. As shown, it comprises a horizontally disposed base mounting plate 50 which is attached by being welded or bolted to frame means 14 at apex point 20. Fitted onto base plate 50 are a pair of downwardly disposed, spaced apart parallel yoke members 52 perpendicular to the axis of symetry of said frame and having threadable ends 53 and being held onto base plate 50 by adjustment nuts 54 which are, as shown, placed above and below plate 50 on ends 53 to permit adjustable alignment thereof. Machined into the bottommost portion of the inner side, of each of yoke members 52 is curved depression 56 into which the downwardly disposed center portion of curved axle 58 is set.

Slideably mounted onto axle 58 between said yoke members is the upper end 59 of vertically disposed main pivot member 60 on to which lower pivot means 49 is attached. Set within end 59 is ball-bearing unit 62 through which axle 58 passes, which allows pivot member 60 to readily slide back and forth on said axle in and out relative to frame 14. One reason for the sliding motion is to allow the automatic repositioning of pivot member 60 in the event that it is dislodged from its normal position, as for example, by reason of the obstruction of the free swing of pendulum means 44 through disturbances such as any impacts with the user that may occur with the end portions of pendular members 12. In this manner, considerable, lateral forgiveness is provided so that impact with the user by the padded end portions 46 would not cause injury to the user and allow easy repositioning of the unit in its basic, normal operating position. As will herein be explained below, this sliding motion also permit the establishment of complex pendular movement patterns to provide a more rigorous exercise scheme for this user.

It will be noted, as shown in FIG. 7, that curved axle 58 is not welded or otherwise firmly fixed to yoke members 52. This allows the easy removal of the pivot and pendulum assemblies from the yoke members to allow changing the period of pendulum oscillation by substituting alternate assemblies containing pendular members which could be shorter, longer, heavier or lighter than those currently attached.

Figure 8:
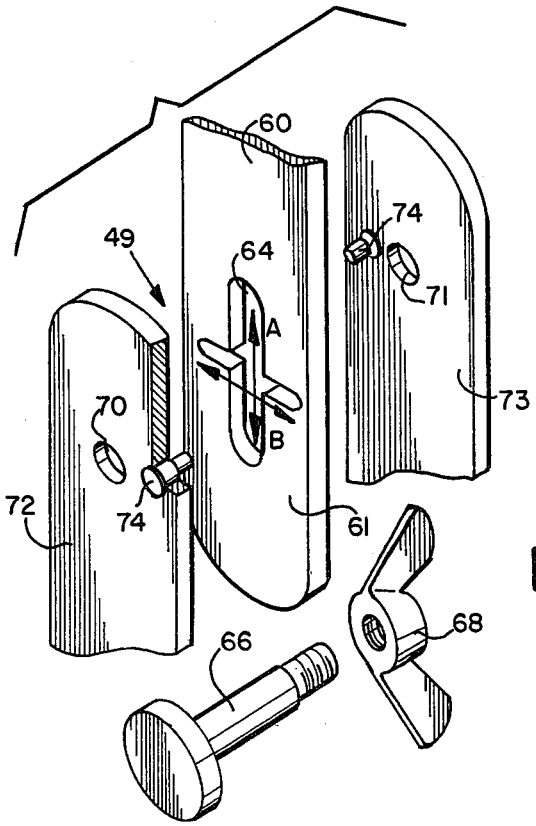
FIG. 8 is an exploded isometric view on an enlarged scale of the lower pivot means of the subject invention.

At the lower end 61 of main pivot member 60 is lower pivot point 49. This is to adjust the angular relationship of pendular members 12 and is shown in detail in FIG. 8. Machined into lower end 61 is a more or less symetrical cross-shaped slot 64. A pivot pin 66 is provided which is threaded at one end for engagement by wing nut 68, so that upon assembly, pin 66 will extend through mating apertures 70 and 71 which are defined in anchor plates 72 and 73 said anchor plates being positioned on the upper ends of each of the two pendular members 12. As shown in FIG. 8, pivot pin 66 also extends through the vertical portion of cross-shaped slot 64 and is sized with respect to the it so that when loosened, pivot pin 66 may travel relatively vertically within the slot as shown by the double-ended arrow "A" in FIG. 8. Angular positioning of pendular members 12 is accomplished by a set of tracking pins 74, one of which protrudes from the opposing surfaces of anchor plates 72 and 73. These are set to move laterally within the horizontal portion of cross-shaped slot 64 shown by double-ended arrow "B". Accordingly, when the angular relationship of pendular members 12 with respect to each other is to be altered, wing nut 68 is merely loosened and pin 66 moved upwardly or downwardly within the vertical portion of slot 64. This causes tracking pins 74 to move sideways within the horizontal portion of slot 64 relatively toward and away from each other, depending upon whether the adjustment to be made is to be less or more angular. The geometric configuration of these parts will accordingly ensure that the main pivot member 60, bisects whatever angle found between the two pendular members 12 is established to set up a completely symetrical apparatus. Thus, relatively easy adjustment of all the main aspects of this apparatus to meet the particular exercise needs of any user is possible.

With this understanding of how the subject invention is constructed, let us now turn to a consideration of how it operates. After the relative vertical position and angular reposition and angular relationship of the two pendular members 12 has been adjusted, as hereinabove described, and the user has set training device 10 to the position desired, he then merely grasps one of pendular members 12 and pulls it toward him to start pendulum means 34 swinging from side to side. If a purely lateral force, that is there is no forwardly directed component of motion is provided the pendulum will simply swing back and forth in an oscillatory plainar motion with main pivot member remaining at the lowermost point on axle 58 most of the time. The amplitude and period decay characteristics of this motion will be set by the pendular length and mass according to well-established principles of physics and the frictional losses in bearing member 62. As each one of the padded ends 46 passes by the user, he must first see it and then dance, bob and weave, duck, or in some other way avoid it so that he will not be struck thus, accomplishing the stated objective of improving the user's peripheral vision, footwork and upper body agility. If, in starting the pendular members moving, the user imparts forward as well as a sidewise, lateral thrust, the pivot member 60 will be caused to move back and forth on axle 58 as well as from side to side. When this is done the ends of the pendular members 12 begin to describe more complex and irregular patterns, such as a figure 8, thus, considerably increasing the difficulty of the exercise and providing a greater potential benefit to the user. Thus it can be seen that the objectives stated above, have been met in a simple easy-to-use sports training device.

It is to be understood that the foregoing suggested apparatus as exemplified by the figures, is intended to be illustrative of a preferred embodiment of the subject invention and that many options will readily occur to those skilled in the art without departure from the spirit or the scope of principals of the subject invention as defined in the attached claims.

What I claim is:

1. A sports training device for improving the peripheral vision, footwork and upper body agility of a user, said device being adapted to be operated by said user and comprising:

(a) frame means adapted to support said device when in use, said frame means further comprising means to attach said device to a vertically disposed wall;

(b) oscillatory pendulum means comprising two angularly disposed, perpendicularly suspended pendular members operably connected by attachment means to said frame, said members being adapted to follow an oscillating path when set in motion by said user;

(c) pivot means within said pendulum means adapted to establish particular oscillatory path taken by said pendular members when they are set in motion and further containing angular adjustment means adapted to establish the angular relationship between said members; and (d) vertical adjustment means adapted to change the vertical relationship of said frame with said user and further comprising locking means adapted to hold said frame at the vertical height set after such change.

2. The device of claim 1, wherein said attachment means comprises mount means connected to said frame at an unobstructed, outer extremity thereof, said mount means having a pair of parallel spaced apart, yoke members threadably held thereon by a plurality of adjustment nuts, said yoke members each being perpendicular to the axis of symetry of said frame and each having a depression in the inner side of the bottom-most portion thereof, said adjustment nuts allowing the individual alignment of said yokes, one with another.

3. The device of claim 2, wherein said pivot means comprises a main pivot member having upper and lower portions, an outwardly directed curved axle set between said yoke members, within said depressions thereof an integral ball-bearing member in said upper portion of said pivot member through which said curved axle passes so that said bearing member forms an upper pivot point allowing said pendulum means to slide along said axle inwardly and outwardly relative to said frame, and further to oscillate within the plane of said pendular members.

4. The device of claim 3, wherein said main pivot member further contains a lower pivot point located in the lower portion of said main pivot member, said lower pivot point being a cross-shaped slot machined into said pivot member, said slot having horizontal and vertical portions and being adapted to accommodate said angular adjustment means.

5. The device of claim 4, wherein said angular adjustment means comprises a pivot pin, adapted to fit through a mating aperture within a pair of anchor plates, one attached to the top of each of said pendular members, said pivot pin attaching said anchor plate topped pendular members one to either side of said main pivot member and further, being of such dimensions that it will freely pass through said vertical portion of said cross-shaped slot and move up and down within said vertical portion to achieve a plurality of successive positions, said positions being held in place by integral clamping means, threadably mounted onto the outer end of said pivot pin, said angular adjustment means further comprising a set of tracking pins, one on each of said anchor plates and inwardly protruding from opposing the inner surfaces thereof, said pins being adapted to fit one on each side of said horizontal portion of said cross-shaped slot and track therein in such a manner that when the angle of the pendular members is to be decreased, such decrease may be accomplished by moving said pivot pin upwardly within said vertical slot portion, said movement causing said tracking pins to move inwardly within said horizontal slot portion as in accordance with the motion of said pivot pin one to the other and where said angle is to be increased, said pivot pin is moved downwardly within said vertical portion causing said tracking pins to move outwardly within said horizontal portion, whereby the angular relationship of said pendular members can be adjustably changed said change being made so that said angle is always bisected by said main pivot member.

6. The invention of claim 5, wherein said vertical adjustment means comprises an upper and lower horizontal mounting brace, attached to said frame, the ends of which are adapted to slideably fit into a set of inwardly, opening gaps, one in each of a pair of parallel, vertical, complimentary, Z-shaped channels which are mounted onto said wall.

7. The invention of claim 6, wherein said locking means comprises a locking pad threadably attached to said frame and located at the lowermost extremity of said frame between said Z-shaped channels, said pad being adapted to be moved inwardly and outwardly relative to said wall, such that when it is moved inwardly, said frame will rotate causing the lower of said braces to rotate outwardly and the upper end of said braces to rotate inwardly within said Z-shaped channels said rotation causing a frictional bearing force against said channels which is sufficient to anchor said frame in the vertical position wherein it has been set.

8. The invention of claim 7, wherein said pendular members are round.

9. The invention of claim 8, wherein the outer ends of said pendular members are padded.

10. A sports training device adapted for operation by a user and comprising:

a. a frame for attaching said device to a surface and for supporting said device in spaced relation to said surface;

b. first pivot means attached to said frame and including arcuate support means operatively associated therewith;

c. second pivot means for slidingly engaging said arcuate support means; and d. pendulum means operatively associated with said second pivot means and including at least one member depending from said second pivot means, and means for adjusting the angular positioning of said member with respect to said second pivot means.

11. The device of claim 10, further comprising vertical adjustment means slidingly associated with portions of said frame which are attached to said surface, and operatively associated with portions of said frame which are attached to said first pivot means.

* * * * *